US005120239A

United States Patent [19]

Witek, Jr.

[11] Patent Number: 5,120,239

[45] Date of Patent: Jun. 9, 1992

[54] RETAINING MECHANISM FOR SECURING A LAMP BASE WITHIN A SOCKET

[75] Inventor: Roman J. Witek, Jr., Gibraltar, Mich.

[73] Assignee: Ford Motor Company, Dearborn, Mich.

[21] Appl. No.: 772,305

[22] Filed: Oct. 7, 1991

[51] Int. Cl.[5] ..... H01R 13/627

[52] U.S. Cl. ..... 439/349; 439/360

[58] Field of Search ..... 439/349, 828, 829, 833, 439/839, 840, 859, 356, 360, 611-619, 699, 242, 243, 244, 232

[56] References Cited

U.S. PATENT DOCUMENTS

| | | | |
|---|---|---|---|
| 480,472 | 8/1892 | Melotte . | |
| 1,933,027 | 10/1933 | Paradun | 439/828 |
| 2,254,706 | 9/1941 | Mueller et al. | 439/232 |
| 2,319,461 | 5/1943 | Kelchner, Jr. | 439/232 |
| 2,446,461 | 8/1948 | Diver | 439/232 |
| 2,619,515 | 11/1952 | Doane | 439/349 |
| 2,786,189 | 3/1957 | Sargis | 339/75 |
| 2,856,738 | 10/1958 | Deuschle | 51/187 |
| 3,075,165 | 1/1963 | Donlevy | 339/91 |
| 3,111,353 | 11/1963 | Nelson | 339/50 |
| 3,171,002 | 2/1965 | Kinnear | 200/133 |
| 3,215,969 | 11/1965 | Verrone | 339/21 |
| 3,281,757 | 10/1966 | Bonhomme | 339/91 |
| 3,609,641 | 9/1971 | Luce | 339/93 |
| 4,072,386 | 2/1978 | Wallo | 339/91 R |
| 4,606,593 | 8/1986 | McKenzie | 439/828 |
| 4,630,877 | 12/1986 | Moore | 339/60 M |
| 4,647,132 | 3/1987 | Mikola | 339/91 L |

FOREIGN PATENT DOCUMENTS

| | | | |
|---|---|---|---|
| 2230603 | 1/1974 | Fed. Rep. of Germany | 439/242 |
| 581608 | 10/1946 | United Kingdom | 439/828 |

*Primary Examiner*—David L. Pirlot

*Attorney, Agent, or Firm*—Paul K. Godwin, Jr.; Roger L. May

[57] ABSTRACT

An improved retaining mechanism for a lamp socket employs a retaining spring with a torsion relief coil to prevent permanent deformation during the assembly of the spring to the socket.

8 Claims, 1 Drawing Sheet

RETAINING MECHANISM FOR SECURING A LAMP BASE WITHIN A SOCKET

RELATED APPLICATION

This application is related to copending U.S. Ser. No. 07/630,415, filed on Dec. 19, 1990, commonly assigned to the assignee hereof.

BACKGROUND OF THE INVENTION

1. Field of the Invention

The present invention is directed to the field of automotive lamp and socket assemblies and more specifically to the area of an improved retaining mechanism to secure a generally parallelopiped-shaped lamp base within a socket.

2. Description of the Prior Art

A prior art wedge base lamp and socket is disclosed in commonly assigned U.S. Patent 4,647,132. The patent describes a retaining mechanism for a lamp socket wherein a single wire spring element is mounted external to the lamp socket, but protrudes into the lamp socket opening. In this manner, the portions of the spring element that protrude into the socket opening provide both insertion interference to the forward ends of ramped projections extending from either end of the lamp base and frictional retention against the rearward ends of the ramped projections when the wedge base element is fully inserted.

The spring used in the latest embodiment of the '132 device in production is shown in FIG. 1 hereof as a generally "C" or "U" shaped element 300 having a pair of legs 310 and 312 integrally joined together at respective corners 306 and 308 by a base member 304. The base member 304 has a slight offset bend at point 302 that makes leg 312 slightly longer than leg 310. The remote end 311 of leg 312 has an inward bend so that it may be secured to a portion of the socket during installation and prevent subsequent slipping of the spring from its installed position on the socket. The remote end point 309 of leg 310 contains an outward bend to provide a cam surface. The cam surface provided by the bend in the remote end 309 is used during installation of the spring on the socket by providing a sliding surface once leg end 311 has been secured in place.

From time to time it has been found that the prior art spring shown in FIG. 1 when installed in the socket of the '132 patent is ineffective in retaining the lamp base in the socket. It has been found that the spring sometimes becomes deformed during installation due to severe bending stresses present at corners 306 and 308. Because the spring has to be stretched outwardly to be placed on the sockets, instances have occurred where springs have become permanently deformed; and, therefore, have less holding biased ability for holding the lamp base in place.

SUMMARY OF THE INVENTION

It is an object of the present invention to overcome problems encountered in the prior art by providing stress relief in a retention spring used to retain a lamp base within a socket.

The present invention utilizes an integrally formed torsion coil in the base member of a "U" shaped spring wire that separates retention legs which extend into the socket to provide interference contact with ramped projections extending from the ends of a generally parallelopiped-shaped lamp base.

It is another object of the present invention to facilitate the use of automatic equipment for installation of the spring-into-socket assembly by providing a pair of inwardly directed half-coil bends at the remote ends of the spring legs.

DETAILED DESCRIPTION OF THE PREFERRED EMBODIMENT

Figure 3:
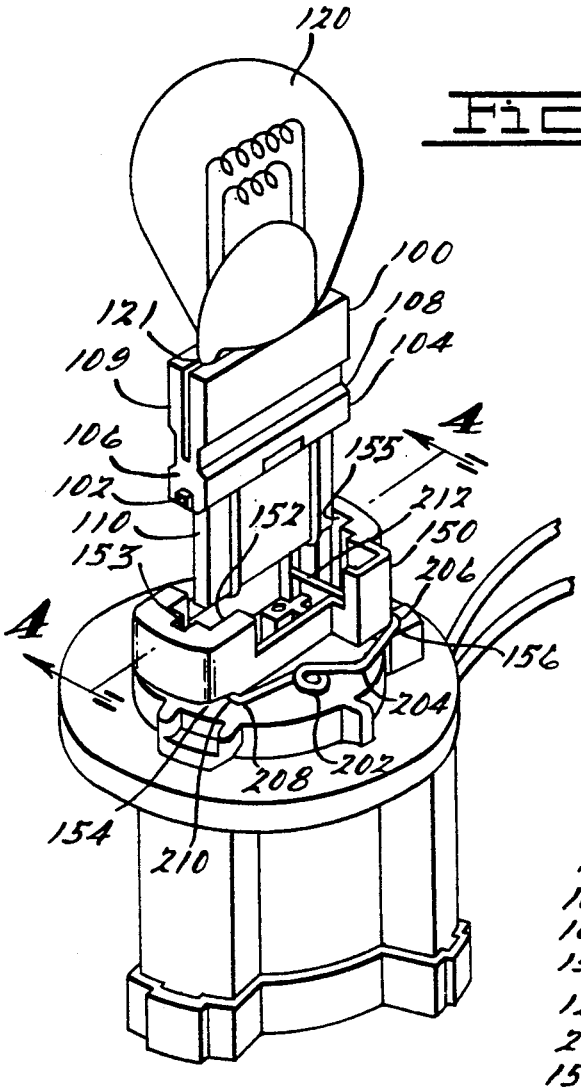
FIG. 3 is a perspective view of a lamp socket assembly which incorporates the present invention.
Figure 4:
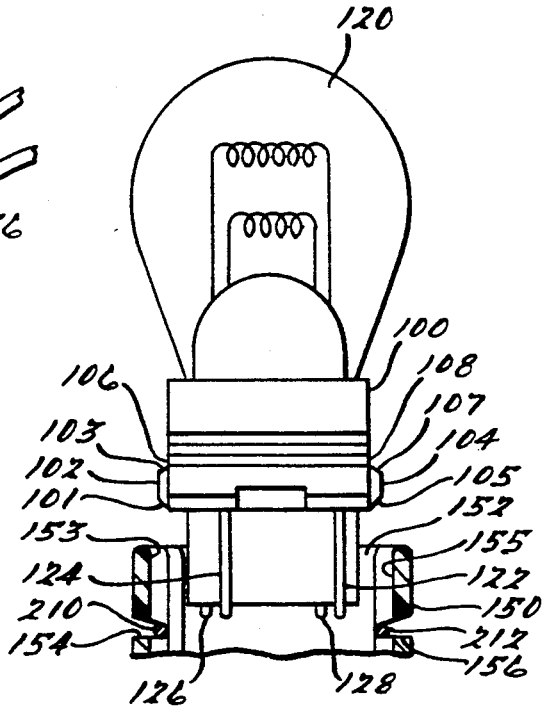
FIG. 4 is a partial cross section of the lamp socket assembly shown in FIG. 3 and taken along lines 4—4.
Figure 2:
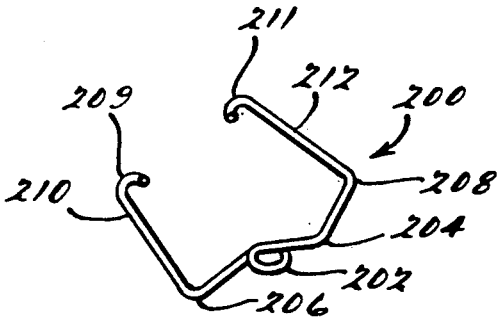
FIG. 2 illustrates the improvement made to the spring retention mechanism for the lamp socket described herein.
Figure 1:
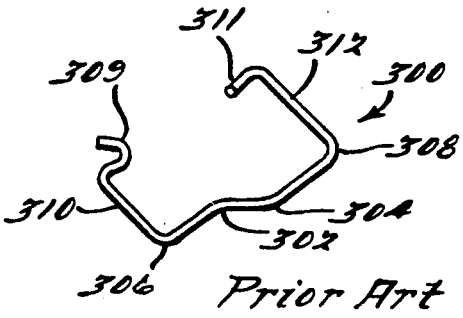
Prior Art Fig. 1.
FIG. 1 is a drawing of a prior art spring member prior to being embodied in a socket of the type described herein.

A single embodiment of the invention is shown in FIGS. 2–4 as being incorporated into a socket 150 configured to retain the wedge base element 100 of a lamp 120.

The lamp 120 is shown in the drawings as a dual filament type having four filament lead wires extending through the sealed envelope base portion 121.

The lamp base 100 is formed of a molded insulated material, such as nylon, and has an upper portion 109 having a generally rectangular parallelopiped shape with its length dimension being the major dimension along the sealed base envelope portion of the lamp, its height dimension being a submajor dimension and its width dimension being the most minor dimension. The upper portion 109 is configured to compressively grip and retain the sealed envelope base portion 121 of the lamp 120.

The lamp base element 100 also includes a bottom portion 110 which extends from and is integral with the upper portion 109. The bottom portion 110 includes internally formed vertical apertures (not shown but parallel to the height dimension) through which the filament wires 122, 124, 126 and 128 extend from the lamp 120. The filament lead wires are individually bent in opposing directions so as to extend vertically along the opposite outer surfaces of the bottom portion 110.

The upper portion 109 of the lamp base 100 includes a pair of ramped retaining projections 102 and 104 respectively extending from the relatively narrow end surfaces 106 and 108. The ramped retaining projections 102 and 104 respectively contain lower insertion ramp surfaces 101 and 105 that each define a normal directed generally downward and away from the lamp 120. The ramped retaining projections 102 and 104 also contain respective upper locking ramp surfaces 103 and 107 that define normals which are directed generally upwards and towards the lamp 120. With respect to the horizontal (a plane extending through both ramped projections at common points), the normal extending from each of the lower ramped surfaces 101 and 105 is of a lower angle than the normal extending from each of the upper locking ramp surfaces 103 and 107. The upper and lower ramp surfaces interact and cause horizontal movement of the retaining means located in a socket 150 with different degrees of resistance during the insertion or removal of the lamp with respect to the socket.

The molded socket 150 contains a generally rectangular opening 152 that corresponds to the generally rectangular cross-section profile of the lamp base element 100 and extends down into a socket cavity. A pair of vertical channels 153 and 155 are disposed at either end of the opening 152 so as to allow the ramped projections 102 and 104 to enter into the opening 152. Below the opening 152, a pair of slotted openings 154 and 156 extend transverse to respective channels 153 and 155.

A spring wire 200 is mounted externally of the socket 150 and has a generally rectangular "C" or "U" shape. Spring wire 200 is bent so as to have a pair of legs 210 and 212 respectively and integrally joined by a base element 204 at corners 206 and 208. The base portion 204 is formed with a torsion coil 202 intermediate the two legs 210 and 212. The remote ends 209 and 211 of respective legs 210 and 212 have inwardly directed half coils formed thereon to facilitate the use of automated equipment to grip the spring and stretch the ends outwardly during assembly onto the socket 150. During that assembly process the torsion coil 202 relieves some of the stress that would otherwise be substantially applied as cantilever stresses to corners 206 and 208 and, therefore, allows for assembly without incurring permanent deformation of the spring.

The spring wire 200 is mounted on the socket 150 in slot openings 154 and 156. The leg portions 210 and 212 of the spring wire 200 are disposed, when assembled onto the socket, to be within the respective slot openings 154 and 156. Leg portions 210 and 212 extend transverse to respective channels 153 and 155 so as to interfere with the insertion of the lamp base 100 by contacting the lower ramp surfaces 101 and 105 of the respective ramped projections 102 and 104. By utilizing the improved spring wire 200 that remains preloaded with a sufficient bias to provide a constant inward force, the insertion of the lamp base 100 into the socket opening 152 will cause the forward (lower) ramp surfaces 101 and 105 to contact the transversing leg portions. Continuing insertion effort causes the leg portions 210 and 212 to be pushed outward with respect to the slots 154 and 156 against the spring combined bias of the torsion coil 202 and the cantilevered bias offered at corners 206 and 208. During the last few millimeters prior to being fully inserted, the biased spring wire 200 contracts inwardly along the rearward (upper) locking ramp surfaces 103 and 107 of the respective ramp projections 102 and 104 to hold the lamp base securely in the socket.

In this configuration, the retention spring continues to maintain the frictional bias for which it was designed and the torsional coil prevents the permanent deformation that may otherwise occur during the assembly process.

It will be apparent that many modifications and variations may be implemented without departing from the scope of the novel concept of this invention. Therefore, it is intended by the claims to cover all such modifications and variations which fall within the true spirit and scope of the invention.

I claim:

1. An improved retaining mechanism for a lamp socket configured to accept a generally rectangular parallelopiped shaped lamp base with ramped projections extending from opposite end surfaces of said base and including a socket body having an open cavity configured for accepting, through motion along a linear path, the insertion and removal of said base with said ramped projections and a means for frictionally resisting the insertion and removal motion of said ramped projections in said socket opening wherein said resistance means includes a spring wire element having a pair of leg portions that extend into said cavity transverse to the insertion and removal path of said lamp base, and said spring wire contains a base portion integrally joining said leg portions at one end thereof, wherein the improvement comprises a torsion coil formed in said base portion intermediate of said leg portions.

2. An improved retaining mechanism as in claim 1, wherein said spring wire element is substantially "U" shaped with said base portion joining said legs for cantilever bending with respect to said base portion and said legs extending in generally parallel directions from opposite ends of said base portion, and said base portion is located outside said socket body cavity.

3. An improved retaining mechanism as in claim 1, wherein said leg portions of said spring wire element traverse portions of the socket cavity where the ramped projections of an inserted lamp base will pass to frictionally resist said insertion and any subsequent removal.

4. An improved retaining mechanism as in claim 1, wherein said leg portions of said spring wire element have end terminations remote from said base portion and each of said terminations are bent in a half coil towards the opposite leg portion.

5. An improved retaining mechanism as in claim 1, wherein said leg portions of said spring wire element have end terminations remote from said base portion and each of said terminations are hooked inwardly towards the opposite leg portion.

6. An improved retaining mechanism as in claim 1, wherein said leg portions of said spring wire element have end terminations remote from said base portion, each of said terminations are hooked inwardly towards the opposite leg portion and said terminations are outside said socket body cavity.

7. An improved retaining mechanism as in claim 1, wherein said base portion of said spring wire is formed with at least one coil to provide a resilient relief point for said spring wire and thereby prevent permanent deformation of the spring when assembled onto said socket body.

8. An improved retaining mechanism as in claim 1, wherein said base portion of said spring wire is formed with a single turn coil to provide a resilient relief point for said spring wire and thereby prevent permanent deformation of the spring when assembled onto said socket body.

* * * * *